US010755643B2

(12) United States Patent
Yoshida

(10) Patent No.: US 10,755,643 B2
(45) Date of Patent: Aug. 25, 2020

(54) DISPLAY DEVICE AND DRIVING METHOD THEREOF

(71) Applicant: Sharp Kabushiki Kaisha, Sakai, Osaka (JP)

(72) Inventor: Tokuo Yoshida, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/475,387

(22) PCT Filed: Sep. 29, 2017

(86) PCT No.: PCT/JP2017/035458
§ 371 (c)(1),
(2) Date: Jul. 2, 2019

(87) PCT Pub. No.: WO2019/064487
PCT Pub. Date: Apr. 4, 2019

(65) Prior Publication Data
US 2020/0219446 A1 Jul. 9, 2020

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3291; G09G 2310/0256; G09G 2310/0262; G09G 2330/021
See application file for complete search history.

(56) References Cited

U.S. PATENT DOCUMENTS

2013/0093653 A1* 4/2013 Ota ..... G09G 3/3233 345/77
2013/0093737 A1* 4/2013 Ota ..... G09G 3/3275 345/204
(Continued)

FOREIGN PATENT DOCUMENTS

JP 2003-224437 A 8/2003
JP 2009-069571 A 4/2009
JP 2017-010000 A 1/2017

OTHER PUBLICATIONS

Ota Hitoshi, Translation of JP 2009069571, Apr. 2, 2009 (Year: 2009).*
(Continued)

*Primary Examiner* — Dmitriy Bolotin
(74) *Attorney, Agent, or Firm* — Keating & Bennett, LLP

(57) ABSTRACT

The present application provides a display device and a driving method thereof which can drive a driving transistor with lower power consumption when displaying an image.

An organic EL display device applies voltage to switch on/off a driving transistor (M1) to a bottom gate electrode (2) of the driving transistor (M1) having a double gate structure, and applies a data voltage (Vdata) depending on data signals to a top gate electrode (6) as back gate voltage (Vbg). With this configuration, variation width of the voltage value can be smaller in comparison with a case to apply the data voltage to the bottom gate electrode (2).

4 Claims, 7 Drawing Sheets

(51) Int. Cl.
*G09G 3/3266* (2016.01)
*G09G 3/3291* (2016.01)

(52) U.S. Cl.
CPC ... *G09G 3/3291* (2013.01); *G09G 2310/0256* (2013.01); *G09G 2310/0262* (2013.01); *G09G 2330/021* (2013.01)

(56) References Cited

U.S. PATENT DOCUMENTS

| | | | | |
|---|---|---|---|---|
| 2014/0168194 | A1 | 6/2014 | Kong et al. | |
| 2016/0042694 | A1* | 2/2016 | Lim | G09G 3/3233 345/78 |
| 2016/0300900 | A1 | 10/2016 | Miyake | |
| 2018/0061908 | A1* | 3/2018 | Shim | H01L 27/326 |
| 2018/0158406 | A1* | 6/2018 | Kim | G09G 3/3283 |
| 2018/0190194 | A1* | 7/2018 | Zhu | G09G 3/3258 |
| 2019/0259822 | A1* | 8/2019 | Jeon | H01L 27/3262 |

OTHER PUBLICATIONS

Official Communication issued in International Patent Application No. PCT/JP2017/035458, dated Dec. 26, 2017.

Tai et al., "Three-Transistor AMOLED Pixel Circuit With Threshold Voltage Compensation Function Using Dual-Gate IGZO TFT", IEEE Electron Device Letters, vol. 33, No. 3, Mar. 2012, pp. 393-395.

* cited by examiner

DISPLAY DEVICE AND DRIVING METHOD THEREOF

TECHNICAL FIELD

The disclosure relates to a display device and a driving method thereof, and more particularly, to a display device including a display element driven by current such as an organic Electro Luminescence (EL) display device.

BACKGROUND ART

Organic EL display devices are known as thin, high picture quality, low power consumption display devices. In organic EL display devices, a plurality of pixel circuits including organic EL elements (also referred to as Organic Light Emitting Diode (OLED) or "display element") that are self-luminous display elements driven by current and driving transistors are arranged in a matrix shape.

Configurations of pixel circuits in the related art included in such organic EL display devices will be described. FIG. 6 is a diagram illustrating a configuration of a pixel circuit 111 according to PTL 1, and FIG. 7 is a diagram illustrating a timing chart in order to drive the pixel circuit 111 illustrated in FIG. 6. As illustrated in FIG. 6, the pixel circuit 111 includes one organic EL element OLED, three transistors M1 to M3, a storage capacitor Cst, and a compensation capacitor Ccp. All these transistors M1 to M3 are N-channel type transistors. The transistor M1 is a driving transistor to control drive current to supply to the organic EL element OLED and is a transistor with a double gate structure including a bottom gate terminal Gb and a top gate terminal Gt. The transistor M2 is a writing transistor to charge the storage capacitor Cst with data voltage Vdata given to a data signal line Di in order to apply the voltage (data voltage) Vdata depending on data signals to the bottom gate terminal Gb of the driving transistor M1. The transistor M3 is a compensation transistor to charge the compensation capacitor Ccp for performing compensation for dispersion of threshold value voltage of the driving transistor M1 causing luminance variation. Dispersion of threshold value voltage of the driving transistor M1 is compensated by voltage charged in the compensation capacitor Ccp being applied to the top gate terminal Gt as back gate voltage Vbg.

An action of the pixel circuit 111 will now be described. As illustrated in FIG. 7, a potential of a first scanning signal line Saj connected to a control terminal of the writing transistor M2 changes from a low level to a high level in time t1. With this configuration, the writing transistor M2 turns into an on state, and a preset voltage Vpre is written in the storage capacitor Cst as data voltage Vdata through the data signal line Di. As a result, the preset voltage Vpre is given to the bottom gate terminal Gb of the driving transistor M1, and the driving transistor M1 turns into the on state.

At the same time, a potential of a second scanning signal line Sbj connected to the control terminal of the compensation transistor M3 also changes from a low level to a high level, and the compensation transistor M3 turns into the on state. At this time, power source voltage VDD of a high level power source line ELVDD connected to the driving transistor M1 maintains a high level. Therefore, current flows from the high level power source line ELVDD to a node N through the driving transistor M1 and the compensation transistor M3, and the compensation capacitor Ccp is charged with the power source voltage VDD of high level. The power source voltage VDD of high level charged in the compensation capacitor Ccp is applied to the top gate terminal Gt of the driving transistor M1 as the back gate voltage Vbg. At this time, voltage applied to an anode terminal and a cathode terminal of the organic EL element OLED is all high level because the power source voltage VDD of the high level power source line ELVDD and power source voltage VSS of a low level power source line ELVSS is all high level. Therefore, current does not flow in the organic EL element OLED.

At time t2, the writing transistor M2 turns into an off state by the first scanning signal line Saj changing from a high level to a low level. At this time, because the preset voltage Vpre is written in the storage capacitor Cst, the preset voltage Vpre is applied to the bottom gate terminal Gb of the driving transistor M1, and the driving transistor M1 turns into the on state. Because the power source voltage VDD of the high level power source line ELVDD changes from a high level to a low level, current flows from the compensation capacitor Ccp to the high level power source line ELVDD through the compensation transistor M3 and the driving transistor M1. With this configuration, the back gate voltage Vbg applied to the bottom gate terminal Gb begins to decrease, and threshold value voltage of the driving transistor M1 begins to rise.

Then, until time t3 when the preset voltage Vpre becomes not applied to the bottom gate terminal Gb of the driving transistor M1, current flows to the high level power source line ELVDD through the driving transistor M1, and the back gate voltage Vbg decreases accordingly. At time t3 when the back gate voltage Vbg becomes equal to threshold value voltage, current does not flow in the driving transistor M1, and the decrease in the back gate voltage Vbg also stops. Threshold value voltage of the driving transistor M1 is a predetermined value depending on the back gate voltage Vbg of this time, and its dispersion is compensated. For duration from time t2 to time t3, reverse voltage is applied to the anode terminal and the cathode terminal of the organic EL element OLED, and thus current does not flow in the organic EL element OLED, and the organic EL element OLED does not emit light.

At time t3, the potential of the second scanning signal lines Sbj changes from a high level to a low level, and the compensation transistor M3 turns into the off state. The power source voltage VDD of the high level power source line ELVDD changes from a low level to a high level, and the power source voltage VSS of the low level power source line ELVSS changes from a high level to a low level. Furthermore, the potential of the first scanning signal line Saj changes from a low level to a high level, and the writing transistor M2 turns into the on state. With these actions, drive voltage Vdrive depending on the data voltage Vdata is given from the data signal line Di. The drive voltage Vdrive is retained by the storage capacitor Cst and is applied to the bottom gate terminal Gb of the driving transistor M1. Therefore, current depending on the drive voltage Vdrive is supplied from the high level power source line ELVDD to the organic EL element OLED through the driving transistor M1, and the organic EL element OLED emits light with luminance depending on the drive voltage Vdrive.

CITATION LIST

Non-Patent Literature

NPL 1: Ya-Hsiang Tai, Lu-Sheng Chou et al. Three-Transistor AMOLED Pixel Circuit With Threshold Voltage Compensation Function Using Dual-Gate IGZO TFT. IEEE ELECTRON DEVICE LETTER, VOL. 33, NO. 3 Mar. 2012, p. 393-395.

SUMMARY

Technical Problem

However, in the pixel circuit illustrated in FIG. 6, the driving transistor M1 controls current flowing in the driving transistor M1, in other words, current to supply to the organic EL element OLED, by the drive voltage Vdrive depending on the data voltage Vdata input to the bottom gate terminal Gb. On the other hand, the pixel circuit compensates dispersion of threshold value voltage of the driving transistor M1 by controlling the back gate voltage Vbg input to the top gate terminal Gt. Thus, in a case where current flowing in the driving transistor M1 is controlled by the drive voltage Vdrive to apply to the bottom gate terminal Gb, the variation width (Peak to Peak value) of the voltage value of the drive voltage Vdrive needs to be around 20 V. Thus, because the variation width of the voltage value requires the large drive voltage Vdrive, there is a problem that power consumption of the pixel circuit 111 is large.

Thus, an object of the disclosure is to provide a display device including a pixel circuit which can drive a driving transistor with lower power consumption when displaying an image, and a driving method of the display device.

Solution to Problem

A display device according to a certain situation of the embodiment of the disclosure is a display device including: a plurality of data signal lines configured to transmit a plurality of data signals representing an image to be displayed; a plurality of first and second scanning signal lines configured to intersect the plurality of data signal lines; and a plurality of pixel circuits arranged in a matrix shape along with the plurality of data signal lines and the plurality of first and second scanning signal lines, the display device including:

a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, the driving transistor is diode-connected and the first power source voltage is retained by the holding capacitor through the driving transistor in a case where corresponding second scanning signal line is in a select state, the driving transistor is a double gate structure including a first gate electrode and a second gate electrode arranged opposite to the first gate electrode across a channel region, and the display device, after having compensated dispersion of threshold value voltage of the driving transistor, applies voltage to a second control terminal connected to the second gate electrode to turn the driving transistor into an on state, applies voltage that superimposes a voltage value calculated by internal compensation and a change amount of voltage that has changed based on any of the data signals to a first control terminal connected to the first gate electrode as back gate voltage, and controls a current value of the drive current flowing through the driving transistor to make the display element emit light.

A driving method of the display device according to another situation of the embodiment of the disclosure includes: a plurality of data signal lines configured to transmit a plurality of data signals representing an image to be displayed; a plurality of first and second scanning signal lines configured to intersect the plurality of data signal lines; and a plurality of pixel circuits arranged in a matrix shape along with the plurality of data signal lines and the plurality of first and second scanning signal lines, the display device including:

a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, and the driving transistor is a double gate structure including a first gate electrode and a second gate electrode arranged opposite to the first gate electrode across a channel region, the driving method of the display element including:

performing internal compensation for dispersion of threshold value voltage of the driving transistor;

supplying a data signal to the holding capacitor under a state where corresponding one of the second scanning signal lines is in a non-select state and corresponding one of the first scanning signal lines is in a select state;

applying voltage that superimposes a voltage value calculated by an internal compensation circuit and a change amount of voltage that has changed based on the data signals to a first control terminal connected to the first gate electrode as back gate voltage; and controlling a current value of the drive current flowing through the driving transistor by the back gate voltage and supplying the drive current to the display element.

Advantageous Effects of Disclosure

According to the display device of a certain situation described above, the display device applies voltage to switch on/off the driving transistor to either the first control terminal or the second control terminal of the driving transistor having the double gate structure, and applies voltage that superimposes a voltage value calculated by internal compensation and a change amount of voltage that has changed based on the data signal to the other terminal as the back gate voltage. With this configuration, variation width of the voltage value of the data voltage can be smaller in comparison with a case to perform on/off of the driving transistor by the data voltage, and thus power consumption of the organic EL display device when displaying an image can be reduced.

According to the driving method of the display device of another certain situation described above, after having compensated dispersion of threshold value voltage of the driving transistor, the display device applies voltage to the second control terminal connected to the second gate electrode to turn the driving transistor into an on state, and turns the first scanning signal lines into a select state to supply the data voltage to the holding capacitor. Then, the display device applies voltage that superimposes a voltage value calculated by internal compensation and a change amount of voltage that has changed based on the data signal to the first control terminal as the back gate voltage, and controls a current value of the drive current flowing through the driving transistor by the back gate voltage and supplies the drive current to the display element. With this configuration, like the case according to the certain above-mentioned situation, the variation width of the voltage value to control the current value of the drive current can be smaller, and thus power consumption of the organic EL display device when displaying an image can be reduced.

DESCRIPTION OF EMBODIMENTS

1. Basic Study

Figure 1:
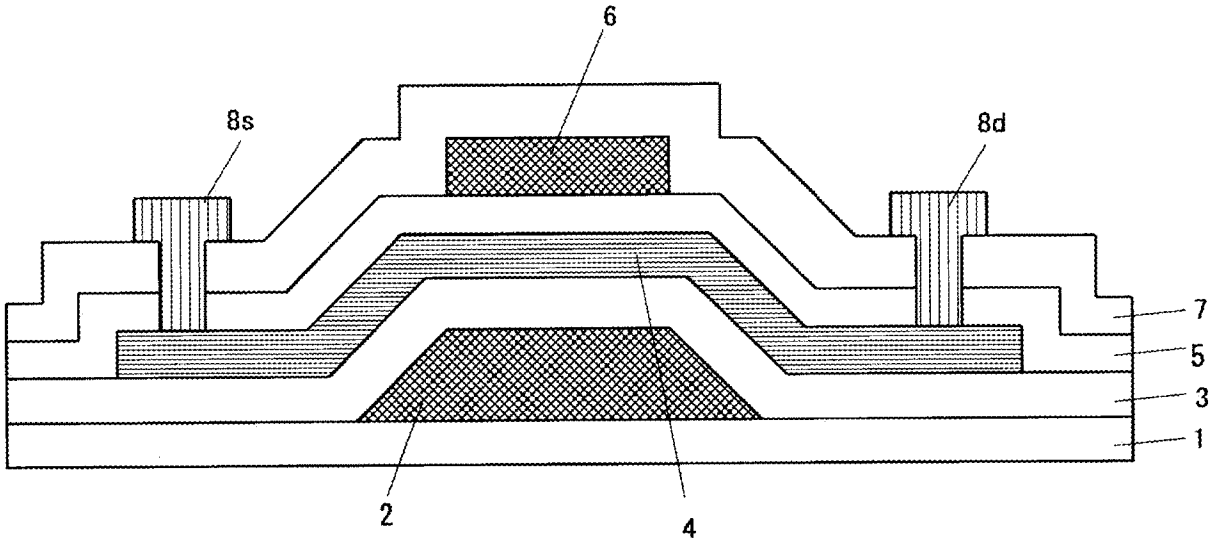
FIG. 1 is a cross-sectional view illustrating a configuration of a thin film transistor of a dual-gate structure including a top gate and a bottom gate included in a pixel circuit of an organic EL display device according to an embodiment of the disclosure.
Figure 2:
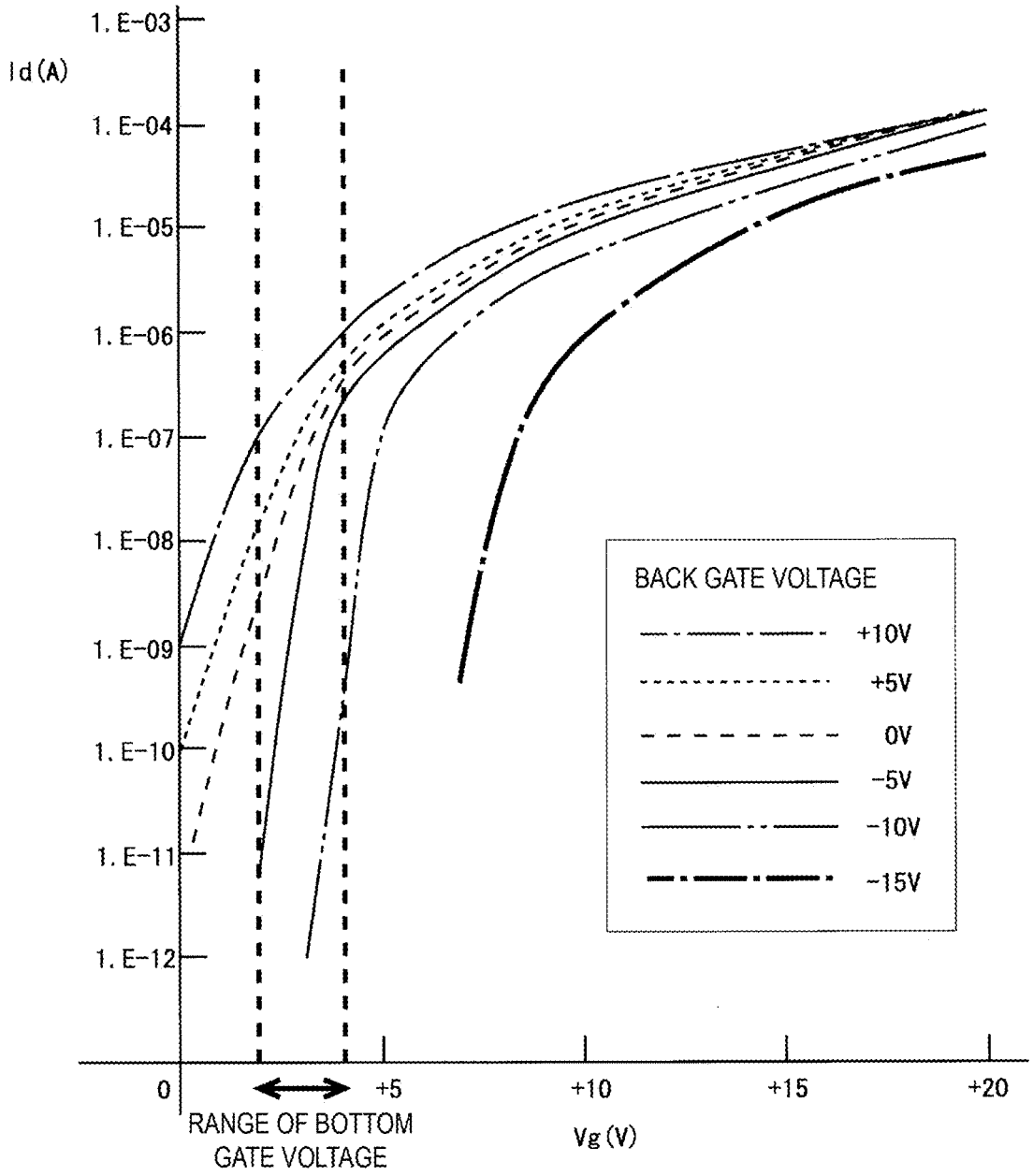
FIG. 2 is a diagram illustrating an electrical characteristic of the thin film transistor of the dual-gate structure illustrated in FIG. 1.

FIG. 1 is a cross-sectional view illustrating a configuration of a Thin Film Transistor (TFT) of a dual-gate structure including a top gate electrode 6 and a bottom gate electrode 2. FIG. 2 is a diagram illustrating an electrical characteristic of the thin film transistor of the dual-gate structure illustrated in FIG. 1. As illustrated in FIG. 1, the bottom gate electrode 2 (the second control electrode) is formed on an insulating substrate 1, and an insulating film 3, a semiconductor film 4, and an insulating film 5 are laminated on the bottom gate electrode 2 in order. Furthermore, the top gate electrode (the first control electrode) 6 is formed in a position on the insulating film 5 opposed to the bottom gate electrode 2, and a passivation film 7 is formed to cover the top gate electrode 6. For example, the semiconductor film 4 is a film including an oxide semiconductor including an In—Ga—Zn—O based semiconductor (indium gallium zinc oxide). Through contact holes formed in the passivation film 7, a drain terminal 8*d* and a source terminal 8*s* directly connected to the semiconductor film 4 are formed. The thin film transistor illustrated in FIG. 1 is an N-channel type transistor, and a current value of drain current is controlled by the gate voltage applied to the bottom gate electrode 2 and the back gate voltage applied to the top gate electrode 6.

Note that the current value of the drain current may be controlled by applying the gate voltage to the top gate electrode 6, and applying the back gate voltage to the bottom gate electrode 2. The thin film transistor is not limited to an N-channel type transistor, and may be a P-channel type transistor. Although the semiconductor film 4 of the thin film transistor is described as a film including an oxide semiconductor, it may be a film formed of amorphous silicon or Low Temperature Poly Silicon (LTPS).

Referring now to FIG. 2, transistor characteristics of a N-channel type transistor will be described. As illustrated in FIG. 2, current values of the drain current Id are illustrated in a case where the gate voltage Vg to apply to the bottom gate electrode 2 is changed in the range of 0 to +20 V, and the back gate voltage Vbg to apply to the top gate electrode 6 is changed in the range of −15 V to +10 V in every 5 V. The thin film transistor having characteristics illustrated in FIG. 2 is in an on state when the drain current Id is in the range of 1.0E-12 A to 1.0E-7 A. Gray scale display is enabled by using a thin film transistor having such characteristics as a driving transistor of a pixel circuit. Note that the thin film transistor is in an off state in a case where the drain current is smaller than 1.0E-12 A.

Assumes that a high level of the gate voltage Vg to apply to the bottom gate electrode 2 is +4 V and a low level +2 V. When the gate voltage Vg is in the high level (+4 V), the back gate voltage Vbg to apply to the top gate electrode 6 of the thin film transistor is changed in the range from −10 V to +5 V. With this configuration, when the thin film transistor is in the on state, the current value of current flowing in the thin film transistor can be controlled by the back gate voltage Vbg. In the embodiment described below, with a condition where the gate voltage Vg of high level (+4 V) is applied to the bottom gate electrode 2, voltage (data voltage) of the data signal in the range from −10 V to +5 V is applied to the top gate electrode 6 as the back gate voltage Vbg.

Note that in a case where the thin film transistor is a P-channel type transistor, transistor characteristics thereof are represented as the characteristics with respective inverted signs of the gate voltage Vg and the back gate voltage Vbg in the characteristics of the N-channel type transistor illustrated in FIG. 2.

2. Embodiment

An embodiment will be described below with reference to the accompanying drawings. Note that, in each transistor mentioned below, the control terminals corresponds to the control terminals, and particularly, a top control terminal connected to the top gate electrode 6 of the driving transistor M1 corresponds to the first control terminal, and a bottom control terminal connected to the bottom gate electrode 2 corresponds to the second control terminal. All the transistors according to the present embodiment are described as N-channel type transistors, but the disclosure is not limited to this type, and the transistors may be P-channel type transistors. The transistors according to the present embodiment is, for example, a thin film transistor, but the disclosure is not limited to this. Furthermore, "connection" in the present description means "electrical connection" unless otherwise specified, and in the scope without departing from the subject matters of the disclosure, it includes not only a case to mean direct connection, but also a case to mean indirect connection through other elements.

2.1 Overall Configuration

Figure 3:
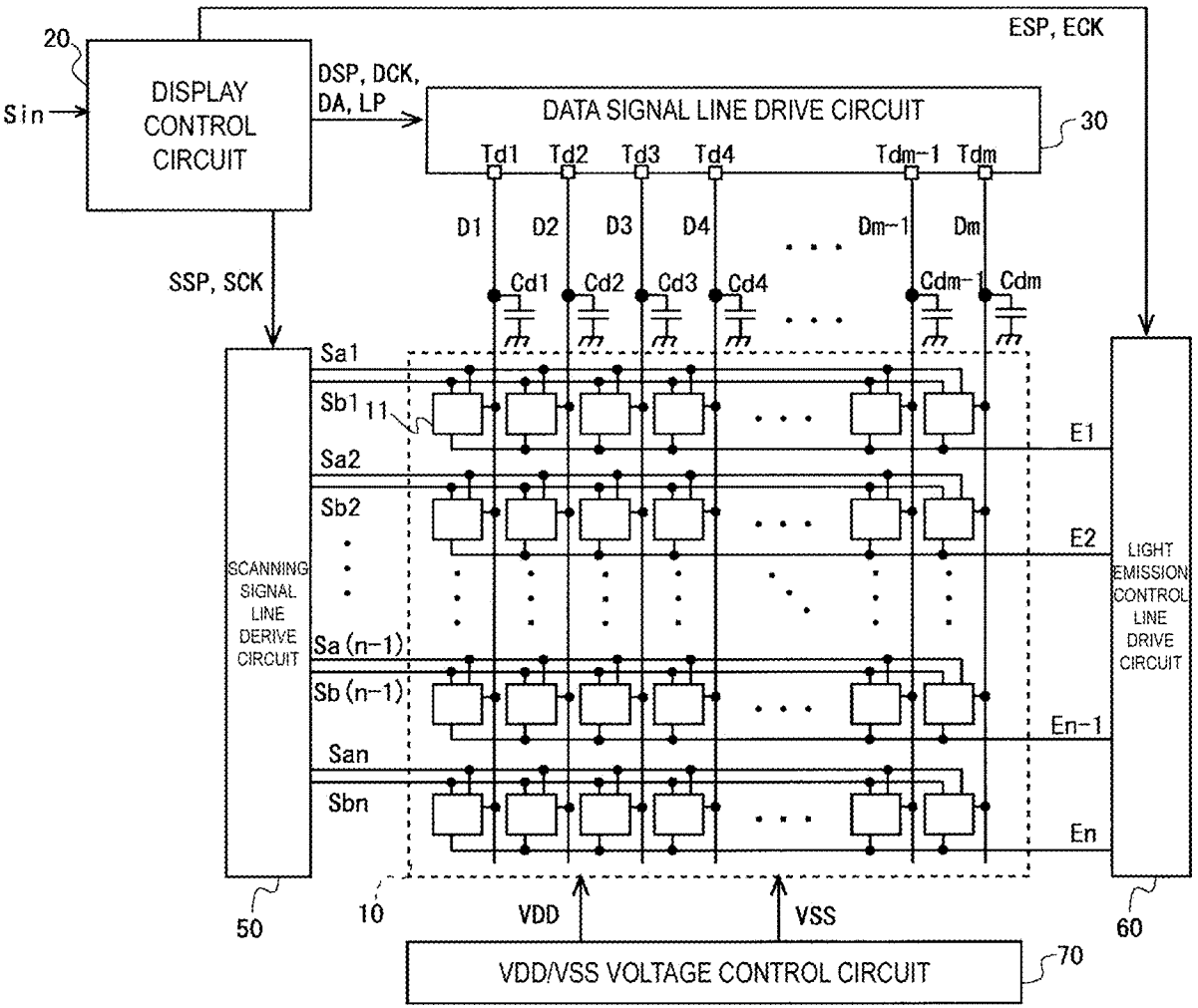
FIG. 3 is a block diagram illustrating an entire configuration of the organic EL display device according to the embodiment of the disclosure.

FIG. 3 is a block diagram illustrating the entire configuration of the organic EL display device according to the embodiment of the disclosure. This organic EL display device is an organic EL display device including a compensation circuit and, as illustrated in FIG. 3, includes a display portion 10, a display control circuit 20, a data signal line drive circuit 30, a scanning signal line drive circuit 50, a light emission control line drive circuit 60, and a VDD/VSS voltage control circuit 70.

On the display portion 10, m (m is an integer equal to or greater than 2) data signal lines D1 to Dm, n (n is an integer equal to or greater than 2) first scanning signal lines Sa1 to San and second scanning signal lines Sb1 to Sbn intersecting these data signal lines D1 to Dm, and n light emission control lines E1 to En parallel to the first scanning signal lines Sa1 to San and the second scanning signal lines Sb1 to Sbn are disposed. As illustrated in FIG. 3, the display portion 10 is provided with m×n pixel circuits 11. These m×n pixel circuits 11 are arranged in a matrix shape along with the above-mentioned data signal lines D1 to Dm, the above-mentioned first and second scanning signal lines Sa1 to San and Sb1 to Sbn, and light emission control lines E1 to En, with each of the pixel circuits corresponding to any one of the above-mentioned m data signal lines D1 to Dm, any one of the above-mentioned n first scanning signal lines Sa1 to San, any one of the second scanning signal lines Sb1 to Sbn, and any one of the n light emission control lines E1 to En. The data signal lines D1 to Dm are connected to the data signal line drive circuit 30, the first and second scanning signal lines Sa1 to San and Sb1 to Sbn are connected to the scanning signal line drive circuit 50, and the light emission control lines E1 to En are connected to the light emission control line drive circuit 60.

On the display portion 10, power source lines not illustrated that are common to respective pixel circuits 11 are disposed. More particularly, a high level power source line ELVDD (a first power source line) to supply power source voltage VDD (first power source voltage) to drive the following organic EL element, and a low level power source line ELVSS (a second power source line) to supply power source voltage VSS (second power source voltage) to drive the organic EL element are disposed. These voltages are supplied from the VDD/VSS voltage control circuit 70. Data signal line capacitors Cd1 to Cdm including parasitic capacitance of m data signal lines D1 to Dm of the pixel circuits 11 respectively are illustrated in FIG. 3.

The display control circuit 20 receives image information to represent an image to be display and an input signal Sin including timing control information for image display from the outside of the organic EL display device, and based on the input signal Sin, outputs various control signals to the data signal line drive circuit 30, the scanning signal line drive circuit 50, and the light emission control line drive circuit 60. More particularly, the display control circuit 20 outputs a data start pulse DSP, a data clock signal DCK, display data DA, and a latch pulse LP to the data signal line drive circuit 30. Furthermore, the display control circuit 20 outputs a scan start pulse SSP and a scan clock signal SCK to the scanning signal line drive circuit 50. Furthermore, the display control circuit 20 outputs a light emission control start pulse ESP and a light emission control clock signal ECK to the light emission control line drive circuit 60.

The data signal line drive circuit 30 includes an m-bit shift register, a sampling circuit, a latch circuit, m D/A converters and the like, which are not illustrated. The shift register includes m bistable circuits cascade-connected with each other, transfers the data start pulse DSP supplied in the first stage in synchronization with the data clock signal DCK, and outputs sampling pulses from each stage. In accordance with the output timing of the sampling pulses, the display data DA is supplied to the sample circuit. The sampling circuit stores the display data DA in accordance with the sampling pulses. When one line of the display data DA is stored in the sampling circuit, the display control circuit 20 outputs the latch pulse LP to the latch circuit. The latch circuit, when having received the latch pulse LP, retains the display data DA stored in the sampling circuit. The D/A converters are provided corresponding to m data signal lines D1 to Dm connected to m output terminals Td1 to Tdm of the data signal line drive circuit 30 respectively, converts the display data DA retained in the latch circuit into the data signals which are analog voltage signals, and supplies the data signals to the data signal lines D1 to Dm.

The scanning signal line drive circuit 50 drives the n first scanning signal lines Sa1 to San and second scanning signal lines Sb1 to Sbn. More particularly, the scanning signal line drive circuit 50 includes a shift register, a buffer, and the like not illustrated. The shift register transfers first scan start pulses SSPa sequentially in synchronization with first scan clock signals SCKa. With this configuration, first scanning signals are supplied to corresponding first scanning signal lines Saj (j=1 to n) via a buffer from each stage of the shift register. m pixel circuits 11 connected to the first scanning signal lines Saj are collectively selected by the first scanning signals (the active first scanning signals) of high level, and as discussed below, the data signals are supplied to the pixel circuits 11 from the data signal lines Di (i=1 to m).

The shift register transfers second scan start pulses SSPb sequentially in synchronization with second scan clock signals SCKb different from the above-mentioned first scan clock signals SCKa. With this configuration, second scanning signals are supplied to the corresponding second scanning signal lines Sbj (j=1 to n) via a buffer from each stage of the shift register. m pixel circuits 11 connected to the second scanning signal lines Sbj are collectively selected by the second scanning signals (the active second scanning signals) of high level, and the power source voltage VDD is supplied to the pixel circuits 11 from the VDD/VSS voltage control circuit 70.

The light emission control line drive circuit 60 drives n light emission control lines E1 to En. More particularly, the light emission control line drive circuit 60 includes a shift register, a buffer, and the like not illustrated. The shift register transfers the light emission control start pulses ESP sequentially in synchronization with the light emission control clock signals ECK. The light emission control signal which is an output from each stage of the shift register is supplied to the corresponding light emission control lines Ej (j=1 to n) via a buffer.

2.2 Connection Relation Between Pixel Circuit and Various Wiring Lines

Figure 4:
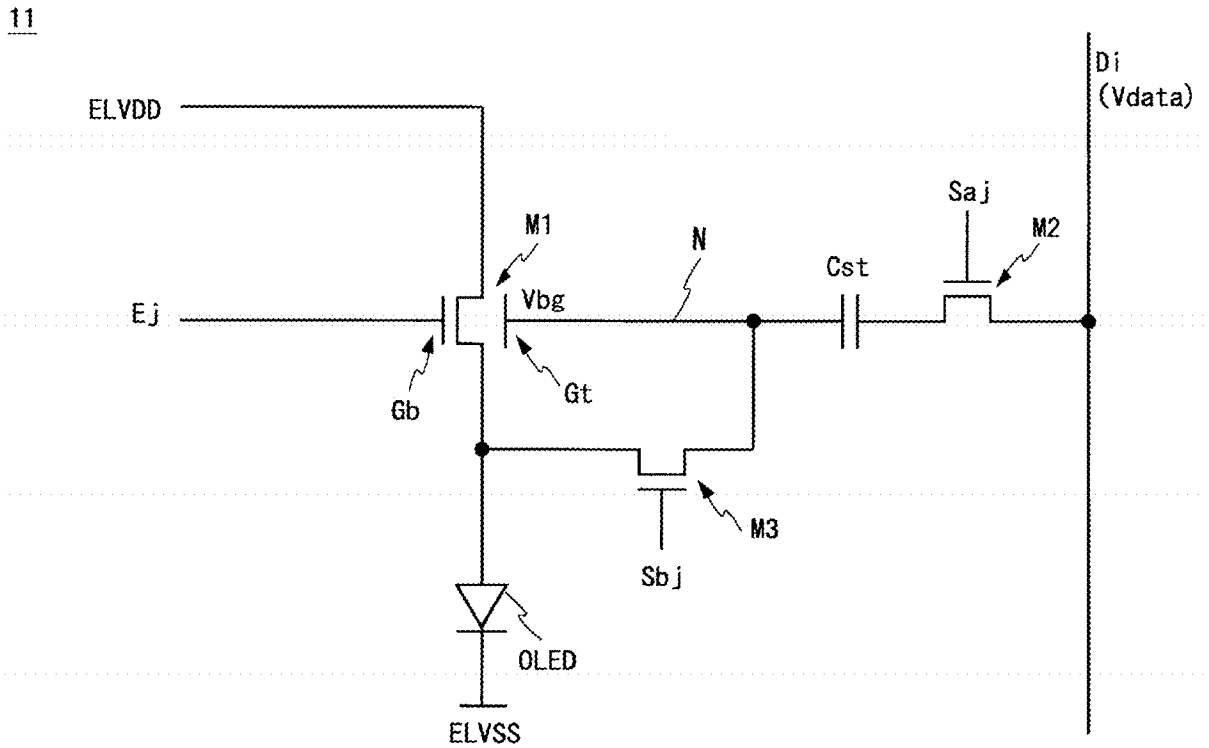
FIG. 4 is a circuit diagram illustrating a connection relation between a pixel circuit and various wiring lines included in the organic EL display device illustrated in FIG. 3.

FIG. 4 is a circuit diagram illustrating a connection relation between a pixel circuit 11 and various wiring lines included in the organic EL display device illustrated in FIG. 3. As illustrated in FIG. 4, the pixel circuit 11 includes an organic EL element OLED, a driving transistor M1, a writing transistor M2, a compensation transistor M3, and a storage capacitor (also referred to as "holding capacitor") Cst retaining data voltage. A first scanning signal line Saj, a second scanning signal line Sbj, a light emission control line Ej, a data signal line Di, a high level power source line ELVDD and a low level power source line ELVSS extending from the VDD/VSS voltage control circuit 70 are connected to the pixel circuit 11. Note that a data signal line capacitor Cdi is formed in each data signal line Di as illustrated in FIG. 3.

The driving transistor M1 is a transistor of the dual-gate structure that a top gate terminal Gt and a bottom gate terminal Gb are formed across a channel region 4*c* as mentioned above. A first conduction terminal is connected to the high level power source line ELVDD, and a second conduction terminal is connected to an anode terminal of the organic EL element OLED. The bottom gate terminal Gb is connected to the light emission control lines Ej, and the top gate terminal Gt is connected to a node N connecting one terminal of the storage capacitor Cst to the top gate terminal Gt of the driving transistor M1. The driving transistor M1 supplies drive current to the organic EL element OLED depending on the back gate voltage Vbg supplied to the top control terminal at the time of on state.

A control terminal of the compensation transistor M3 is connected to the second scanning signal line Sbj. The compensation transistor M3 includes a first conduction terminal connected to a second conduction terminal of the driving transistor M1, and a second conduction terminal connected to the node N. By turning the potential of the light emission control line Ej and the second scanning signal line Sbj into a high level, the driving transistor M1 is connected to the diode by the compensation transistor M3 in the on state, the power source voltage VDD of high level is supplied from the high level power source line ELVDD to the storage capacitor Cst through the driving transistor M1 and the compensation transistor M3, and the storage capacitor Cst is charged by the power source voltage VDD.

A control terminal of the writing transistor M2 is connected to the first scanning signal line Saj. The writing transistor M2 includes a first conduction terminal connected to a terminal of the storage capacitor Cst, and a second conduction terminal connected to the data signal line Di. The writing transistor M2 supplies voltage of the data signal line Di, in other words, the data voltage retained in the data signal line capacitor Cdj, to the storage capacitor Cst depending on selection of the first scanning signal line Saj. With this configuration, the voltage of the terminal of the storage capacitor Cst retaining the power source voltage VDD is pushed up by the data voltage given from the data signal line Di. Therefore, voltage that superimposes a voltage value calculated by internal compensation and a change amount of voltage which have risen by pushing up is supplied to the top gate terminal Gt of the driving transistor M1 as the back gate voltage Vbg.

The driving transistor M1 turns into the on state when the light emission control line Ej is in a select state (high level), and in a case where voltage depending on the data voltage is further supplied to the top gate terminal Gt as the back gate voltage Vbg, the drive current flows through the driving transistor M1 depending on the data voltage. Thus, the driving transistor M1 in the on state functions as a light emission control transistor which supplies the drive current determined by the data voltage to the organic EL element OLED. For the organic EL element OLED, the anode terminal is connected to the second conduction terminal of the driving transistor M1, and the cathode terminal is connected to the low level power source line ELVSS. Therefore, the organic EL element OLED emits light with luminance depending on the data voltage in a case where the drive current determined depending on the data voltage is supplied to the organic EL element OLED from the driving transistor M1.

Note that, in the above description, voltage of one terminal of the storage capacitor Cst retaining the power source voltage VDD is pushed up by an amount of the data voltage due to the data voltage supplied from the data signal lines Di, and the voltage value that has increased by pushing up is superimposed with the voltage value calculated by internal compensation, and is supplied to the top gate terminal Gt of the driving transistor M1 as the back gate voltage Vbg. However, voltage of one terminal of the storage capacitor Cst retaining the power source voltage VDD may be pushed down from a high level by an amount of the data voltage due to the data voltage, and the voltage value that has decreased by pushing down may be superimposed with the voltage value calculated by internal compensation, and be supplied to the top gate terminal Gt of the driving transistor M1 as the back gate voltage Vbg.

In the above description, it is described that the voltage that superposes the voltage value calculated by internal compensation and the change amount of voltage that has changed based on the data signals is applied to the top gate terminal Gt of the driving transistor M1, and the light emission control signal is applied to the bottom gate terminal Gb. However, the voltage that superimposes the voltage value calculated by internal compensation and the change amount of voltage that has changed based on the data signals may be applied to the bottom gate terminal Gb of the driving transistor M1, and the light emission control signal may be applied to the top gate terminal Gt.

2.3 Driving Method

Figure 5:
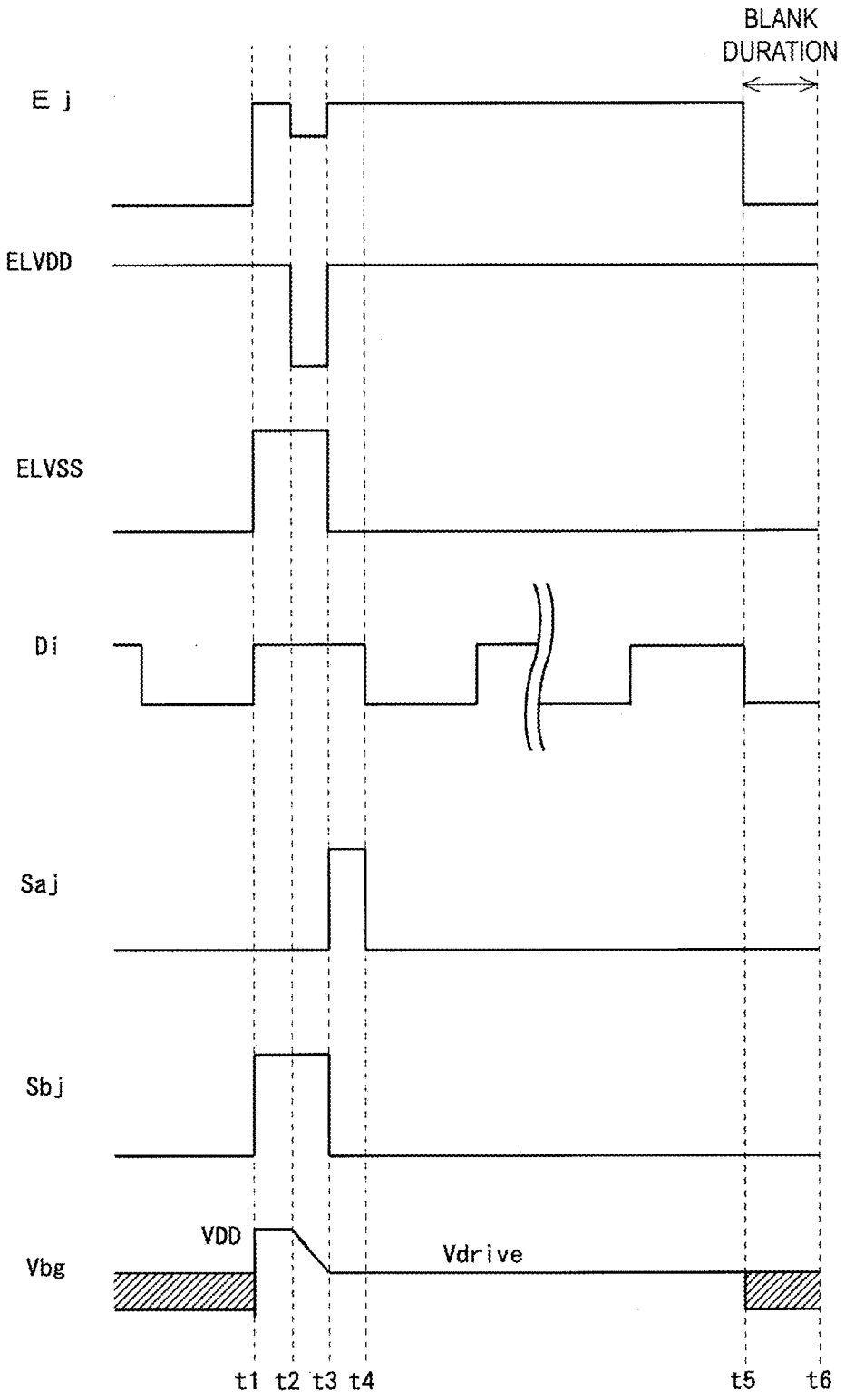
FIG. 5 is a timing chart for describing a driving method of one frame period of the pixel circuit illustrated in FIG. 4.
Figure 6:
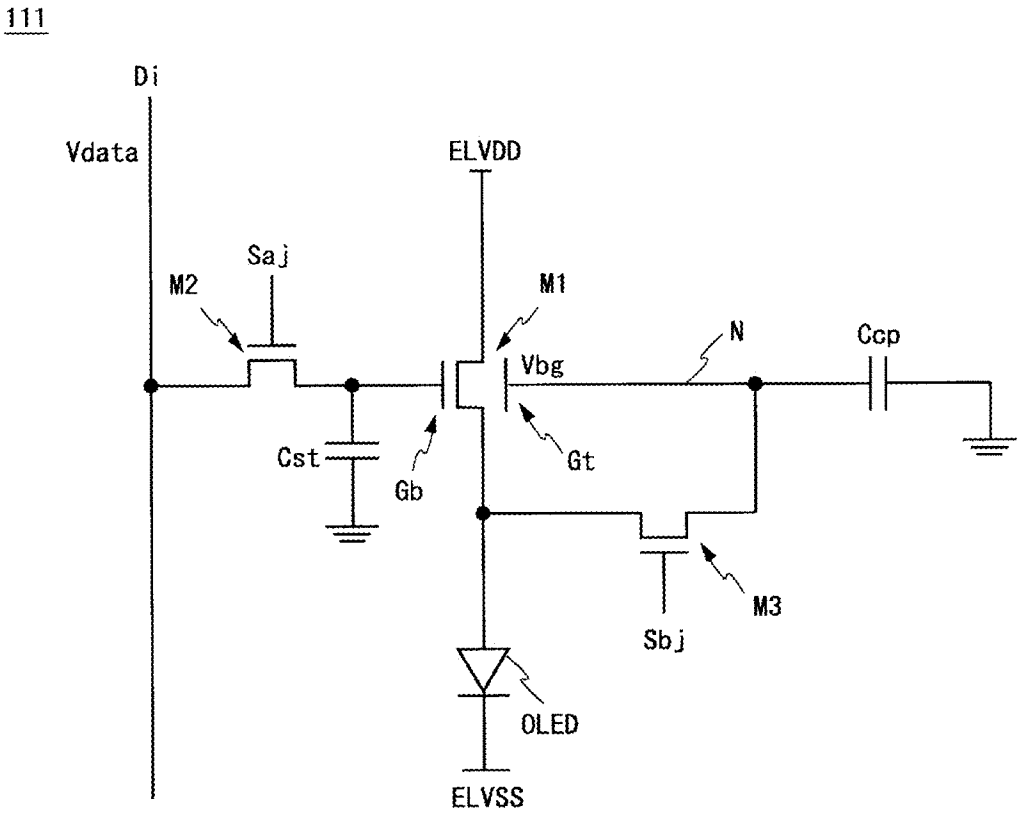
FIG. 6 is a diagram illustrating a configuration of a pixel circuit in the related art.
Figure 7:
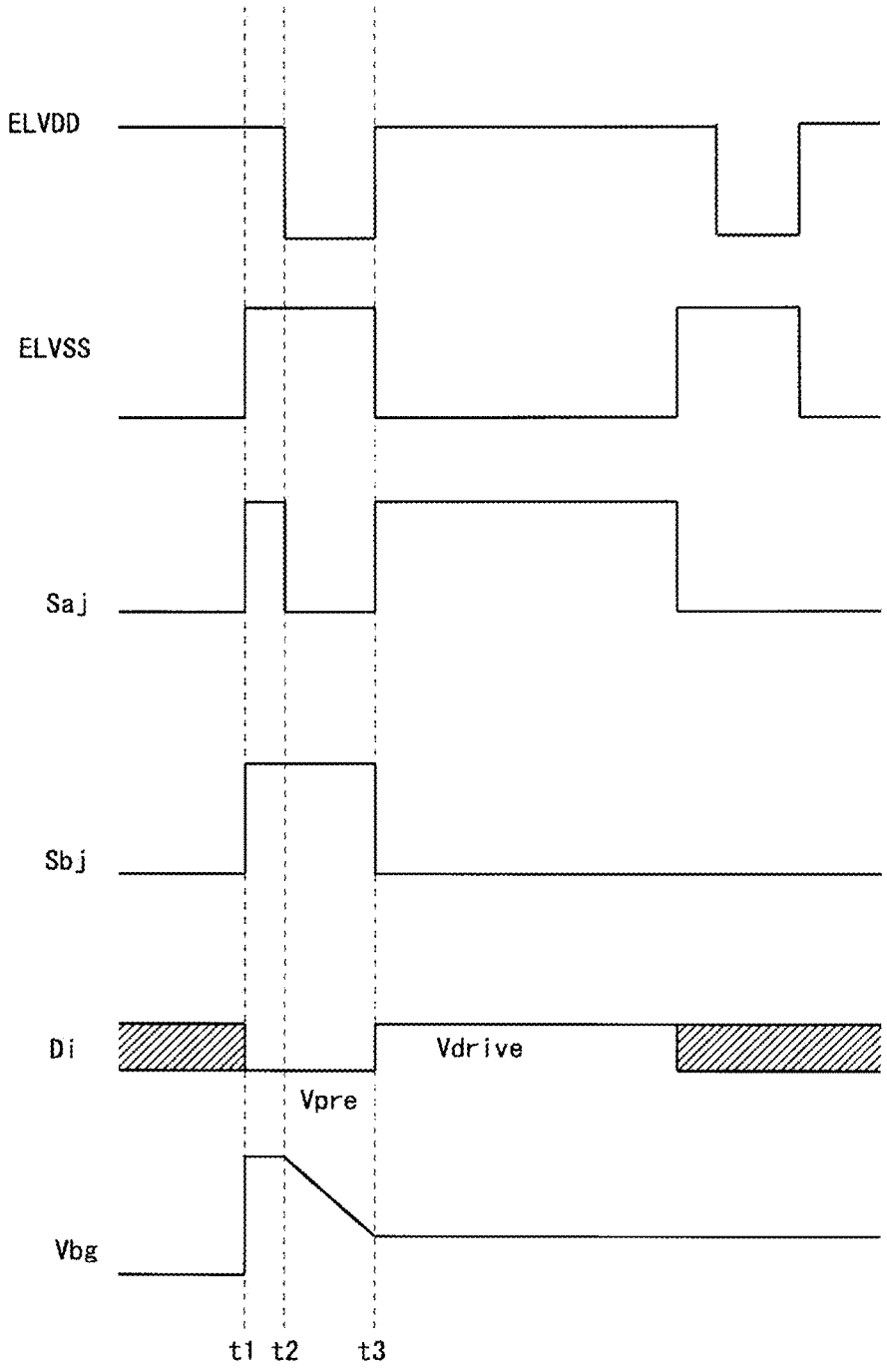
FIG. 7 is a timing chart for describing a driving method of the pixel circuit illustrated in FIG. 6.

A driving method of the organic EL display device according to the present embodiment will be described with reference to FIGS. 4 and 5. FIG. 5 is a timing chart for describing the driving method of one frame period of the pixel circuit 11 illustrated in FIG. 4.

As illustrated in FIG. 5, at time t1, the potential of the light emission control line Ej changes from a low level to a high level. The power source voltage VDD of the high level power source line ELVDD continues a high level, and the power source voltage VSS of the low level power source line ELVSS changes from a low level to a high level. The potential of the second scanning signal line Sbj changes from a low level to a high level. With these actions, the driving transistor M1 and the compensation transistor M3 turns into the on state, and the power source voltage VDD of the high level power source line ELVDD is supplied to the storage capacitor Cst through the driving transistor M1 and the compensation transistor M3. As a result, the storage capacitor Cst is charged at the power source voltage VDD, and the power source voltage VDD is applied to the top gate terminal Gt as the back gate voltage Vbg of the driving transistor M1. At this time, the power source voltage VSS of the low level power source line ELVSS is also in a high level, and thus the light emission control signal of high level is given to the bottom gate terminal Gb of the driving transistor M1. Even in a case where the driving transistor M1 turns into the on state, the drive current is not supplied from the high level power source line ELVDD to the organic EL element OLED.

At time t2, the power source voltage VDD of the high level power source line ELVDD changes from a high level to a low level. Voltage of the light emission control line Ej changes from a high level to an intermediate level between a low level and a high level. Therefore, the driving transistor M1 changes from the on state with a lower on-resistance value to the on state with a higher on-resistance. With these actions, from time t1 to time t2, current flows from the storage capacitor Cst charged at the power source voltage VDD to the high level power source line ELVDD through the compensation transistor M3 and the driving transistor M1. At this time, the on-resistance value of the driving transistor M1 is high, and thus the current value of the current flowing in the driving transistor M1 can be made smaller. This facilitates control of the current value. In this case, the voltage of the storage capacitor Cst gradually decreases from the power source voltage VDD, and thus the back gate voltage Vbg applied to the top gate terminal Gt connected to the storage capacitor Cst also gradually decreases. When the voltage value of the back gate voltage Vbg becomes equal to threshold value voltage of the driving transistor M1, current does not flow in the driving transistor M1, and dispersion of threshold value voltage resulting from a manufacturing process of the driving transistor M1 and from deterioration of the transistor in the use of the organic EL display device is compensated. Note that, in duration from time t2 to time t3, the power source voltage VSS of the low level power source line ELVSS is a high level, and thus charge retained in the storage capacitor Cst does not flow to the organic EL element OLED through the compensation transistor M3. Note that, in the above description, voltage of the light emission control line Ej changes from a high level to an intermediate level between a low level and a high level, but the voltage of the light emission control line Ej may remain in a high level. In this case, an on-resistance value of the driving transistor M1 is low, and thus the current value of the current flowing in the driving transistor M1 increases, and this makes it difficult to be controlled.

At time t3, the potential of the light emission control line Ej changes from the intermediate level to a high level again. With this action, the driving transistor M1 continues the on state, and the on-resistance value also lowers. The power source voltage VDD of the high level power source line ELVDD changes from a low level to a high level, and the power source voltage VSS of the low level power source line ELVSS changes from a high level to a low level. Furthermore, the potential of the first scanning signal line Saj changes from a low level to a high level, and the potential of the second scanning signal line Sbj changes from a high level to a low level. With this configuration, the writing transistor M2 becomes the on state, and the compensation transistor M3 becomes the off state. At this time, the data voltage Vdata by which gray scale display determined by the data signals is enabled is supplied to the data signal line Di. Therefore, the voltage of the storage capacitor Cst is pushed up in a case where the data voltage Vdata is supplied from the data signal line Di to the storage capacitor Cst through the writing transistor M2. As a result, voltage Vdrive that superimposes a voltage value calculated by internal compensation and a change amount of voltage which have risen by pushing up is supplied to the top gate terminal Gt of the driving transistor M1 as the back gate voltage Vbg. The driving transistor M1 in the on state supplies the drive current depending on the voltage Vdrive supplied to the top gate terminal Gt, to the organic EL element OLED.

At time t4, the potential of the first scanning signal line Saj changes from a high level to a low level, and the writing transistor M2 becomes the off state. With this action, supply of the data voltage from the data signal line Di to the storage capacitor Cst is stopped, but the back gate voltage Vbg depending on the data voltage Vdata retained in the storage capacitor Cst is applied to the top gate terminal Gt of the driving transistor M1. As a result, after time t4, the drive current depending on the data voltage Vdata continues being supplied from the high level power source line ELVDD to the organic EL element OLED, and thus the organic EL element OLED continues emitting light.

At time t5, the potential of the light emission control line Ej changes from a high level to a low level, and the driving transistor M1 becomes the off state. With this action, the drive current is not supplied to the organic EL element OLED, and the organic EL element OLED does not emit light. Then until time t6 is blank duration.

2.4 Effects

According to the present embodiment, the organic EL display device applies voltage turning the driving transistor M1 into the on state to the bottom gate terminal Gb of the driving transistor M1 having the double gate structure, and applies voltage that superposes a voltage value calculated by internal compensation and a change amount of voltage that has changed based on the data signals to the top gate terminal Gt6 as the back gate voltage Vbg. With this configuration, variation width of the voltage value can be smaller in comparison with a case to apply the data voltage Vdata to the bottom gate terminal Gb, and thus power consumption of the organic EL display device when displaying an image can be reduced.

Voltage of the light emission control line Ej is changed from a low level to the intermediate level between a low level and a high level when compensating threshold value voltage of the driving transistor M1. With this configuration, the driving transistor M1 changes from the on state with a lower on-resistance value to the on state with a higher on-resistance value. As a result, the current value of the current flowing the driving transistor M1 decreases, and thus control can be performed easily.

Connecting the light emission control line Ej to the bottom gate terminal Gb of the driving transistor M1 allows the driving transistor M1 to also serve a function of a light emission control transistor. Only the capacitor provided to each pixel circuit 11 is the storage capacitor Cst. Thus, the number of transistors and capacitors included in the pixel circuits 11 can be reduced, and thus an organic EL display device having higher resolution can be manufactured.

The display device according to the present embodiment is not particularly limited as long as it is a display device including a display element where luminance and transmittance are controlled by current. The display element for current control includes a Quantum dot Light Emitting Diode (QLED) such as an organic EL element or an inorganic EL element. Examples of the display device including such a quantum dot light emitting diode include a QLED display device such as an organic EL display device including an organic EL element or an inorganic EL display device including an inorganic EL element device.

3. Supplementary Note

3.1 Supplementary Note 1

A display device including: a plurality of data signal lines configured to transmit a plurality of data signals representing an image to be displayed; a plurality of first and second scanning signal lines configured to intersect the plurality of data signal lines; and a plurality of pixel circuits arranged in a matrix shape along with the plurality of data signal lines and the plurality of first and second scanning signal lines, including:

a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of pixel circuits includes a display element, a holding capacitor configured to retain voltage to control drive current to supply to the display element, and a driving transistor configured to supply the drive current to the display element, the driving transistor be connected to a diode and the first power source voltage is retained by the holding capacitor through the driving transistor when corresponding second scanning signal lines are in select state, the driving transistor is a double gate structure including a first gate electrode and a second gate electrode arranged opposite to the first gate electrode in between a channel region, and the display device, after having performed compensation for dispersion of threshold value voltage of the driving transistor, applies voltage to a second control terminal connected to the second gate electrode and turns the driving transistor into the on state, applies voltage that superimposes a voltage value calculated by internal compensation and a change amount of voltage that has changed based on the data signals to a first control terminal connected to the first gate electrode as back gate voltage, and makes the display element emit light by controlling a current value of the drive current flowing through the driving transistor.

3.2 Supplementary Note 2

The display device according to Supplementary Note 1 may be configured further including:

a first power source line configured to supply the first power source voltage to the driving transistor; and a plurality of light emission control lines configured to make the display element emit light or to transmit a control signal turning the driving transistor into on state to each of the plurality of pixel circuits, wherein the display device diode-connects the driving transistor and applies voltage turning the driving transistor into the on state to the second control terminal connected to any of the plurality of the light emission control lines, and supplies the first power source voltage from the first power source line to the holding capacitor through the driving transistor by applying the first power source voltage of a first level to the first power source line, and the display device applies voltage of a second level inverted from the first level to the first power source line and applies voltage of the holding capacitor that gradually decreases to the first control terminal as back gate voltage by causing current to flow from the holding capacitor to the first power source line through the driving transistor, and compensate dispersion of threshold value voltage of the driving transistor by causing a voltage value of the back gate voltage to be threshold value voltage of the driving transistor.

The display device according to Supplementary Note 2 applies voltage of the holding capacitor that gradually decreases to the first control terminal as back gate voltage, and performs compensation for dispersion of threshold value voltage of the driving transistor by causing a voltage value of the back gate voltage to be threshold value voltage of the driving transistor. With this configuration, compensation for dispersion of threshold value voltage of the driving transistor can be performed easily.

3.3 Supplementary Note 3

The display device according to Supplementary Note 2 may be configured that: voltage to apply to the second control terminal connected to any of the light emission control lines is voltage of an intermediate level between a high level and a low level applied to the light emission control line.

The display device according to Supplementary Note 3 can raise an on-resistance value of the driving transistor because voltage to apply to the second control terminal becomes voltage of the intermediate level. With this configuration, the current value of the current flowing in the driving transistor can be easily controlled.

3.4 Supplementary Note 4

The display device according to Supplementary Note 1 may be configured further including:

a second power source line connected to a cathode terminal of the display element and configured to supply the second power source voltage to the display element, wherein a polarity of the second power source voltage applied to the second power source line is the same polarity as the first power source voltage in a case of compensating dispersion of threshold value voltage of the driving transistor, and is a polarity different from the first power source voltage in a case of making the display element emit light.

The display device according to Supplementary Note 4 can make the display element not emit light when compensating dispersion of threshold value voltage of the driving transistor.

3.5 Supplementary Note 5

The display device according to Supplementary Note 1 may be configured that:

the first control terminal of the driving transistor is a terminal connected to a top gate electrode, and the second control terminal is a terminal connected to a bottom gate electrode.

The display device according to Supplementary Note 5 can apply the back gate voltage depending on the data voltage to the top gate electrode of the thin film transistor configuring the driving transistor.

3.6 Supplementary Note 6

A driving method of a display device including: a plurality of data signal lines configured to transmit a plurality of data signals representing an image to be displayed; a plurality of first and second scanning signal lines configured to intersect the plurality of data signal lines; and a plurality of pixel circuits arranged in a matrix shape along with the plurality of data signal lines and the plurality of first and second scanning signal lines, the display device including:

a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, and the driving transistor is a double gate structure including a first gate electrode and a second gate electrode arranged opposite to the first gate electrode across a channel region, the driving method of a display element including:

performing internal compensation for dispersion of threshold value voltage of the driving transistor;

supplying a data signal to the holding capacitor under a state where corresponding one of the second scanning signal lines is in a non-select state and corresponding one of the first scanning signal lines is in a select state;

applying voltage that superimposes a voltage value calculated by an internal compensation circuit and a change amount of voltage that has changed based on the data signals to a first control terminal connected to the first gate electrode as back gate voltage; and controlling a current value of the drive current flowing through the driving transistor by the back gate voltage and supplying the drive current to the display element.

3.7 Supplementary Note 7

The driving method of the display device according to Supplementary Note 6 may be configured further including:

a first power source line configured to supply first power source voltage to the driving transistor; and a plurality of light emission control lines configured to make the display element driven by current emit light or to transmit a control signal turning the driving transistor into the on state to each of the plurality of pixel circuits, wherein the performing internal compensation for dispersion of threshold value voltage of the driving transistor further includes:

diode-connecting the driving transistor and applying voltage turning the driving transistor into the on state to a second control terminal connected to any of the light emission control lines;

supplying the first power source voltage from the first power source line to the holding capacitor through the driving transistor by applying the first power source voltage of a first level to the first power source line;

applying voltage of a second level inverted from the first level to the first power source line and applying voltage of the holding capacitor which has changed based on the data signals given from any of the data signal lines to the first control terminal as the back gate voltage; and causing current to flow from the holding capacitor to the first power source line through the driving transistor until a voltage value of the back gate voltage becomes equal to threshold value voltage of the driving transistor.

The display device according to Supplementary Note 7 can provide similar effects to the disclosure according to Supplementary Note 2.

REFERENCE SIGNS LIST

2 Bottom gate electrode
6 Top gate electrode
11 Pixel circuit
20 Display control circuit
30 Data signal line drive circuit
50 Scanning signal line drive circuit
60 Light emission control line drive circuit
Di Data signal line (i=1 to m)
Saj First scanning signal line (j=1 to n)
Sbj Second scanning signal line (j=1 to n)
Ej Light emission control line (j=1 to n)
ELVDD High level power source line (first power source line)
ELVSS Low level power source line (second power source line)
M1 Driving transistor
M2 Writing transistor
M3 Compensation transistor
Cst Storage capacitor (holding capacitor)
Gt Top gate terminal (first control terminal)
Gb Bottom gate terminal (second control terminal)
OLED Organic EL element (display element)
Vbg Back gate voltage
VDD Power source voltage (first power source voltage)
VSS Power source voltage (second power source voltage)

The invention claimed is:

1. A display device including a plurality of data signal lines configured to transmit a plurality of data signals representing an image to be displayed, a plurality of first and second scanning signal lines configured to intersect the plurality of data signal lines, and a plurality of pixel circuits arranged in a matrix shape along with the plurality of data signal lines and the plurality of first and second scanning signal lines, the display device comprising: a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, the driving transistor is diode-connected and a first power source voltage is retained by the holding capacitor through the driving transistor in a case where corresponding second scanning signal line is in a select state, the driving transistor is a double gate structure including a first gate electrode and a second gate electrode arranged opposite to the first gate electrode across a channel region, the display device, after having compensated dispersion of threshold value voltage of the driving transistor, applies voltage to a second control terminal connected to the second gate electrode to turn the driving transistor into an on state, applies voltage that superimposes a voltage value calculated by internal compensation and a change amount of voltage that has changed based on any of the data signals to a first control terminal connected to the first gate electrode as back gate voltage, and controls a current value of the drive current flowing through the driving transistor to make the display element emit light, the display device further includes a first power source line configured to supply the first power source voltage to the driving transistor, and a plurality of light emission control lines configured to make the display element emit light or to transmit a control signal turning the driving transistor into on state to each of the plurality of pixel circuits, wherein the display device diode-connects the driving transistor and applies voltage turning the driving transistor into the on state to the second control terminal connected to any of the plurality of the light emission control lines, and supplies the first power source voltage from the first power source line to the holding capacitor through the driving transistor by applying the first power source voltage of a first level to the first power source line, and the display device applies voltage of a second level inverted from the first level to the first power source line and applies voltage of the holding capacitor that gradually decreases to the first control terminal as back gate voltage by causing current to flow from the holding capacitor to the first power source line through the driving transistor, and compensate dispersion of threshold value voltage of the driving transistor by causing a voltage value of the back gate voltage to be threshold value voltage of the driving transistor.

2. The display device according to claim 1, wherein voltage to apply to the second control terminal connected to any of the light emission control lines is voltage of an intermediate level between a high level and a low level applied to the light emission control line.

3. A display device including a plurality of data signal lines configured to transmit a plurality of data signals representing an image to be displayed; a plurality of first and second scanning signal lines configured to intersect the plurality of data signal lines; and a plurality of pixel circuits arranged in a matrix shape along with the plurality of data signal lines and the plurality of first and second scanning signal lines, the display device comprising: a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, the driving transistor is diode-connected and a first power source voltage is retained by the holding capacitor through the driving transistor in a case where corresponding second scanning signal line is in a select state, the driving transistor is a double gate structure including a first gate electrode and a second gate electrode arranged opposite to the first gate electrode across a channel region, the display device, after having compensated dispersion of threshold value voltage of the driving transistor, applies voltage to a second control terminal connected to the second gate electrode to turn the driving transistor into an on state, applies voltage that superimposes a voltage value calculated by internal compensation and a change amount of voltage that has changed based on any of the data signals to a first control terminal connected to the first gate electrode as back gate voltage, and controls a current value of the drive current flowing through the driving transistor to make the display element emit light, the display device further includes a second power source line connected to a cathode terminal of the display element and configured to supply the second power source voltage to the display element, and wherein a polarity of the second power source voltage applied to the second power source line is the same polarity as the first power source voltage in a case of compensating dispersion of threshold value voltage of the driving transistor, and is a polarity different from the first power source voltage in a case of making the display element emit light.

4. A driving method of a display device including a plurality of data signal lines configured to transmit a plurality of data signals representing an image to be displayed, a plurality of first and second scanning signal lines configured to intersect the plurality of data signal lines, and a plurality of pixel circuits arranged in a matrix shape along with the plurality of data signal lines and the plurality of first and second scanning signal lines, the display device including:

a data signal line drive circuit configured to respectively output the plurality of data signals to the plurality of data signal lines; and a scanning signal line drive circuit configured to respectively drive the plurality of first and second scanning signal lines selectively, wherein each of the plurality of pixel circuits corresponds to any one of the plurality of data signal lines and any one of the plurality of first and second scanning signal lines each, each of the plurality of pixel circuits includes a display element, a holding capacitor configured to retain voltage to control drive current to supply to the display element, and a driving transistor configured to supply the drive current to the display element, and the driving transistor is a double gate structure including a first gate electrode and a second gate electrode arranged opposite to the first gate electrode across a channel region, the driving method of a display element comprising:

performing internal compensation for dispersion of threshold value voltage of the driving transistor;

supplying a data signal to the holding capacitor under a state where corresponding one of the second scanning signal lines is in a non-select state and corresponding one of the first scanning signal lines is in a select state;

applying voltage that superimposes a voltage value calculated by an internal compensation circuit and a change amount of voltage that has changed based on the data signals to a first control terminal connected to the first gate electrode as back gate voltage; and controlling a current value of the drive current flowing through the driving transistor by the back gate voltage and supplying the drive current to the display element, wherein the display device further includes a first power source line configured to supply first power source voltage to the driving transistor, and a plurality of light emission control lines configured to make the display element driven by current emit light or to transmit a control signal turning the driving transistor into the on state to each of the plurality of pixel circuits, and the performing internal compensation for dispersion of threshold value voltage of the driving transistor further includes diode-connecting the driving transistor and applying voltage turning the driving transistor into the on state to a second control terminal connected to any of the light emission control lines, supplying the first power source voltage from the first power source line to the holding capacitor through the driving transistor by applying the first power source voltage of a first level to the first power source line, applying voltage of a second level inverted from the first level to the first power source line and applying voltage of the holding capacitor which has changed based on the data signals given from any of the data signal lines to the first control terminal as the back gate voltage, and causing current to flow from the holding capacitor to the first power source line through the driving transistor until a voltage value of the back gate voltage becomes equal to threshold value voltage of the driving transistor.

* * * * *